US006906583B1

(12) United States Patent
Aude

(10) Patent No.: US 6,906,583 B1
(45) Date of Patent: Jun. 14, 2005

(54) METAL OXIDE SEMICONDUCTOR FIELD EFFECT TRANSISTOR (MOSFET) CASCODE CURRENT MIRROR

(75) Inventor: Arlo Aude, Atlanta, GA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/641,246

(22) Filed: Aug. 14, 2003

(51) Int. Cl.[7] ..... G05F 1/10
(52) U.S. Cl. ..... 327/543
(58) Field of Search ..... 327/530, 534, 327/535, 537, 538, 543

(56) References Cited

U.S. PATENT DOCUMENTS 4,583,037 A 4/1986 Sooch
5,959,446 A * 9/1999 Kuckreja ..... 323/315

* cited by examiner

*Primary Examiner*—Jeffrey Zweizig
(74) *Attorney, Agent, or Firm*—Vedder Price Kaufman & Kammholz, P.C.

(57) ABSTRACT

A metal oxide semiconductor field effect transistor (MOSFET) cascode current mirror circuit architecture capable of operating at a low power supply voltage and with only one input reference number while maintaining a high dynamic signal range.

21 Claims, 7 Drawing Sheets

METAL OXIDE SEMICONDUCTOR FIELD EFFECT TRANSISTOR (MOSFET) CASCODE CURRENT MIRROR

BACKGROUND OF THE INVENTION

1. Field of the Invention

The present invention relates to current mirror circuits, and in particular, to metal oxide semiconductor field effect transistor (MOSFET) cascode current mirror circuits.

2. Description of the Related Art

Current mirror circuits, in general, are well-known in the art and are used in many applications. As is well-known, in a conventional current mirror circuit, an input current source drives one of a pair of transistors interconnected in such a manner that such input current is substantially replicated, or mirrored, at the output of the second transistor. As is also well-known, the relative sizes, or scaling, of the respective transistor dimensions can be designed to establish the desired ratio between the input current and the output, or mirrored, current. Accordingly, one important factor in designing such a current mirror circuit is matching the input and output currents according to the desired proportion or ratio.

Current mirror circuits found in present day integrated circuits (ICs) tend to be implemented using MOSFETs. As ICs have become increasingly dense, in terms of transistor count versus die size, channel lengths of the MOSFETs have also become shorter. Such decreased channel lengths result in decreased output impedances for current mirror circuits. Accordingly, it has become increasingly necessary to provide cascode output circuits to maintain or increase output impedances.

Cascode output stages often exhibit limited voltage ranges in terms of possible biasing voltage for the cascode output stage, as well as possible power supply voltages. With respect to possible power supply voltages, this has become increasingly critical as operating power supply voltages have decreased to 3.3 volts and below.

Referring to FIG. 1, for example, a conventional MOSFET cascode current mirror circuit 10 intended to provide an output current IOUT with an associated output voltage having a high dynamic range relative to its power supply voltage, while also operating with a minimum power supply voltage VDD (relative to the circuit reference or ground potential VSS/GND) is implemented using reference current sources 12, 14 and N-MOSFETs M1, M2, M3, M4, M5, M10, M11, all interconnected substantially as shown. (The reference current sources, 12, 14 can be implemented in a number of well-known ways such that the operating voltage across each current source 12, 14, when implemented with MOSFETs, is equal to the drain-to-source saturation voltage VDSAT.)

Diode-connected transistor M1, driven by current source 14, establishes a bias voltage V10 at the gate terminal of transistor M2. In turn, transistor M2 sinks the current provided by current source 12 and provides a bias voltage V3 at the gate terminal of transistor M3. The current through transistor M3 drives diode-connected transistor M5 as the input to a current mirror circuit formed by transistors M5 and M4. This biasing arrangement results in the equal reference current IREF of current sources 12 and 14 to be mirrored as the channel currents through transistors M3 and M5, and establishing the biasing voltages V10, V11 for the gate terminals of output transistors M10 and M11. Cascode output transistor M10 helps maintain a high output impedance for the output current IOUT at its drain terminal.

Transistors M2 and M4 serve as reference devices in helping to establish the mirrored current and biasing voltages V10, V11. Transistor M1 has a channel width (e.g., 4 microns) which is approximately equal to or less than the channel widths of the reference M2, M4 and output M10, M11 transistors (e.g., 20 microns) so as to maintain the minimum biasing potential for the output transistors M10, M11 (discussed in more detail below). The source follower configuration of transistors M3 and M5 establish the minimum power supply voltage (VDD−VSS/GND) as the sum of two threshold voltages VT (the minimum gate-to-source voltage VGS at which an inversion layer is formed and channel conduction, and therefore drain current flow, begins) plus one MOSFET drain-to-source saturation voltage VDSAT (2*VT+VDSAT).

As power supply voltages continue to decrease, it would be desirable to have a minimum operating power supply voltage less than that offered by the circuit of FIG. 1. Further, it would be desirable to accomplish this without requiring a second current source to generate the biasing voltage for the cascode output transistor.

SUMMARY OF THE INVENTION

In accordance with the presently claimed invention, a metal oxide semiconductor field effect transistor (MOSFET) cascode current mirror circuit architecture is provided which is capable of operating at a low power supply voltage and with only one input reference current while maintaining a high dynamic signal range.

In accordance with one embodiment of the presently claimed invention, MOSFET cascode current mirror circuitry includes reference circuitry, feedback circuitry and cascode output circuitry. The reference circuitry includes a plurality of N telescopically coupled MOSFETs having a plurality of like corresponding channel dimensions and is responsive to reception of a reference current and at least one feedback voltage by providing a reference voltage, wherein N is an integer greater than unity. The feedback circuitry is coupled to the reference circuitry, includes at least one scaled MOSFET, and is responsive to reception of the reference voltage by providing the at least one feedback voltage in relation to the reference voltage. One of the at least one scaled MOSFET has a channel dimension approximately equal to or less than $1/N^2$ of a corresponding one of the first plurality of reference circuitry MOSFET channel dimensions and is responsive to the reference voltage. The cascode output circuitry is coupled to the reference circuitry and the feedback circuitry, and is responsive to reception of the reference voltage and the at least one feedback voltage by providing a cascode output current related to the reference current.

In accordance with another embodiment of the presently claimed invention, MOSFET cascode current mirror circuitry includes reference circuitry, feedback circuitry and cascode output circuitry. The reference circuitry includes a plurality of N telescopically coupled MOSFETs having a plurality of like corresponding channel dimensions and is responsive to reception of at least one reference current and at least one feedback voltage by providing at least one reference voltage, wherein N is an integer greater than unity. The feedback circuitry is coupled to the reference circuitry, includes at least one scaled MOSFET, and is responsive to reception of one of the at least one reference voltage by providing the at least one feedback voltage in relation to the one of the at least one reference voltage. At least one of the at least one scaled MOSFET has a channel dimension approximately equal to or less than $1/N^2$ of a corresponding reference circuitry MOSFET channel dimension and is responsive to the one of the at least one reference voltage. The cascode output circuitry is coupled to the feedback circuitry, includes a second plurality of N telescopically coupled MOSFETs, and is responsive to reception of the at least one feedback voltage by providing a cascode output current related to one or more of the at least one reference current.

DETAILED DESCRIPTION

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Throughout the present disclosure, absent a clear indication to the contrary from the context, it will be understood that individual circuit elements as described may be singular or plural in number. For example, the terms "circuit" and "circuitry" may include either a single component or a plurality of components, which are either active and/or passive and are connected or otherwise coupled together (e.g., as one or more integrated circuit chips) to provide the described function. Additionally, the term "signal" may refer to one or more currents, one or more voltages, or a data signal. Within the drawings, like or related elements will have like or related alpha, numeric or alphanumeric designators.

In conformance with the discussion herein, it will be appreciated and understood by one of ordinary skill in the art that a MOSFET current mirror circuit with a cascode output in accordance with the presently claimed invention can be implemented with a P-MOSFET current mirror circuit and N-MOSFET biasing and cascode output circuit as discussed herein, or alternatively, with an N-MOSFET current mirror circuit and P-MOSFET biasing and cascode output circuitry with appropriate reversals in drain and source terminal connections and power supply voltage polarity to provide an output current source rather than an output current sink circuit, all in accordance with well known conventional circuit design techniques.

Figure 1:
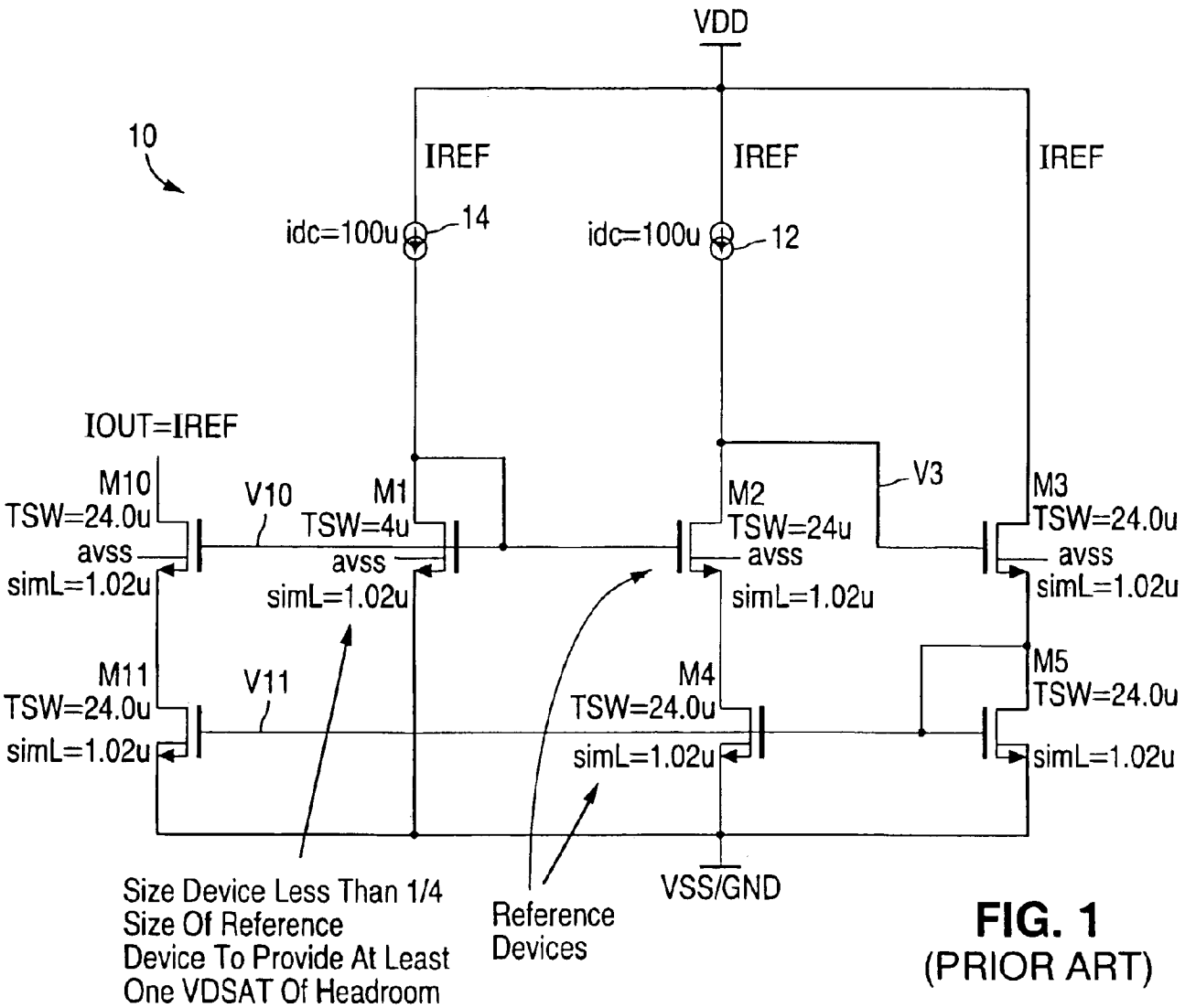
FIG. 1 (PRIOR ART)
FIG. 1 is a schematic diagram of a conventional MOSFET cascode current mirror circuit.
Figure 2:
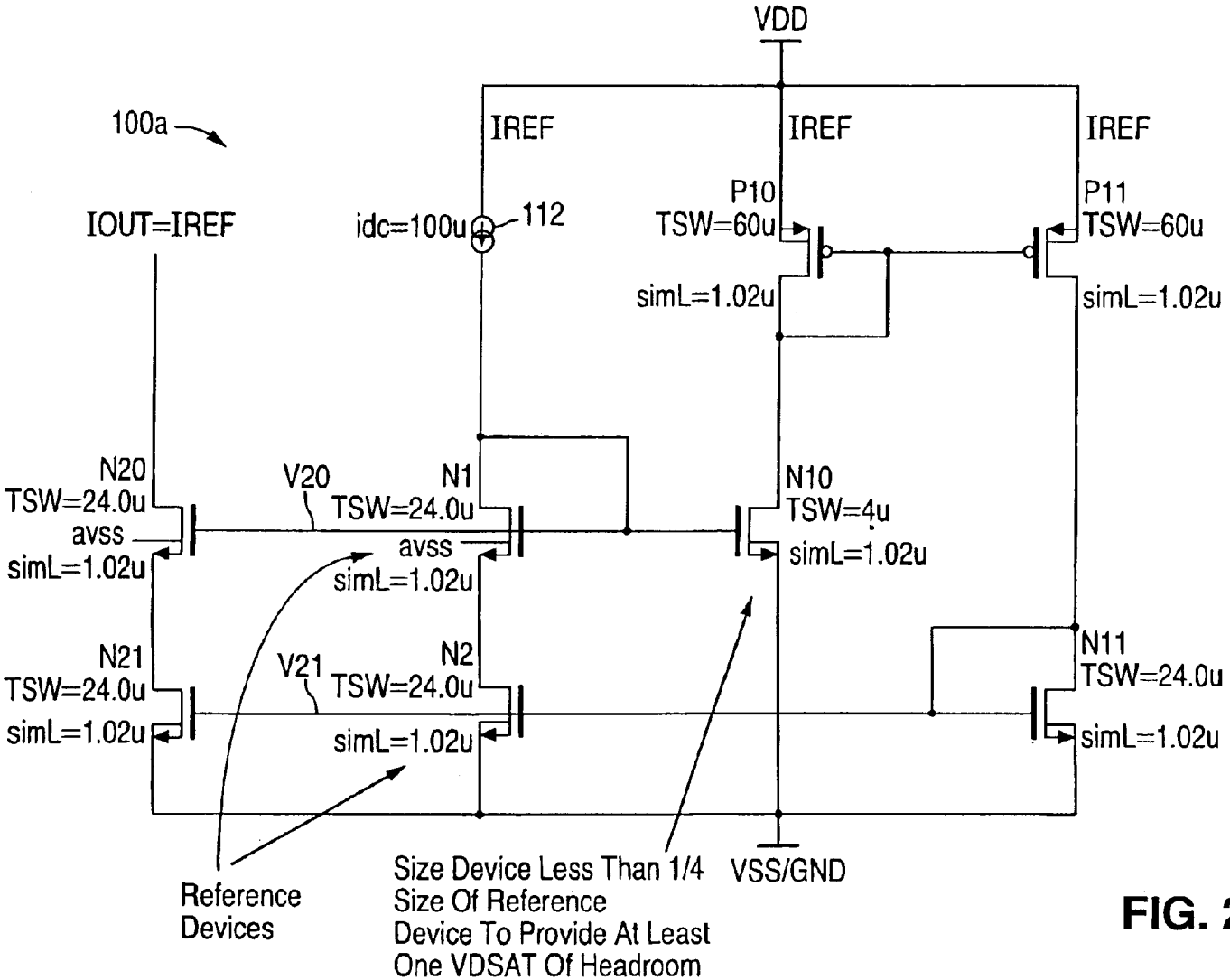
FIG. 2 is a schematic diagram of a MOSFET cascode current mirror circuit in accordance with one embodiment of the presently claimed invention.

Referring to FIG. 2, a MOSFET cascode current mirror circuit 100*a* in accordance with one embodiment of the presently claimed invention includes a reference current source 112 (which can be implemented in a conventional manner such that, when implemented with MOSFETs, has an operating output voltage across its terminals equal to a MOSFET output saturation voltage VDSAT), a current mirror circuit formed by P-MOSFETs P10 and P11, a biasing circuit formed by N-MOSFETs N1, N2, N10, N11, and a cascode output circuit formed by N-MOSFETs N20, N21, all interconnected substantially as shown between the power supply terminals VDD, VSS/GND. The reference current IREF from current source 112 is provided to the drain and gate terminals of diode-connected transistor N1, thereby producing a bias voltage V20 at the gate terminals of transistors N1, N10 and N20. The resulting drain current through transistor N10 drives the current mirror input transistor P10, thereby being mirrored by transistor P11 and provided to the drain and gate terminals of diode-connected transistor N11. Transistor N11 is designed to have a channel width equal to that of transistor N2.

A negative feedback loop is formed by the interaction of transistors N1, N10, P10, P11, N1 and N2. The associated DC biasing points of this loop force the drain current of transistor N2 to be equal to the input reference current IREF. Similarly, the drain currents through the circuit branches formed by transistors P10 and N10 and transistors P11 and N11 are also equal to the input reference current IREF.

In accordance with a well-known circuit design technique (e.g., see U.S. Pat. No. 4,583,037, the disclosure of which is incorporated herein by reference), the dimensions of transistor N10 are scaled in proportion to the corresponding dimensions of the reference transistors N1, N2, and in particular, the channel width of transistor N10 is designed to be approximately equal to or, preferably, less than the channel widths of the reference transistors N1, N2. Accordingly, the gate-to-source voltage VGS of transistor N10 is maintained as equal to the sum of the gate-to-source voltage VGS of transistor N1 plus the drain-to-source saturation voltage VDSAT of transistor N2.

This can be demonstrated in accordance with well-known MOSFET circuit operating characteristics. As is well-known, drain currents ID1 and ID2 of transistors N1 and N10, respectively, can be computed based upon the majority carrier mobility u, the gate capacitance per unit area Cox, the channel width W, channel length L, threshold voltage VT, transistor scaling factor N and the respective gate-to-source voltages VGS1 (transistor N1), VGS2 (transistor N10), as follows:

$$\text{Equation 1:}\quad id_1 = \frac{u \cdot Cox}{2} \cdot \frac{N \cdot W}{L}(VGS_1 - VT)^2$$

$$\text{Equation 2:}\quad id_2 = \frac{u \cdot Cox}{2} \cdot \frac{W}{L}(VGS_2 - VT)^2$$

Setting these currents equal to each other ($id_1 = id_2$) produces Equation 3, which can be simplified and reduced as follows, for scaling factors of N=4 and N=9:

Equation 3:

$$\frac{u \cdot Cox}{2} \cdot \frac{N \cdot W}{L}(VGS_1 - VT)^2 = \frac{u \cdot Cox}{2} \cdot \frac{W}{L}(VGS_2 - VT)^2$$

$$N(VGS_1-VT)^2=(VGS_2-VT) \quad \text{Equation 4}$$

$$\sqrt{N}(VGS_1-VT)=(VGS_2-VT) \quad \text{Equation 5}$$

$$VGS_2=\sqrt{N}(VGS_1-VT)+VT \quad \text{Equation 6}$$

$$VGS_2-VGS_1=\sqrt{N}(VGS_1-VT)+VT-VGS_1 \quad \text{Equation 7}$$

$$VGS_2-VGS_1=\sqrt{N}(VGS_1-VT)-(VGS_1-VT) \quad \text{Equation 8}$$

$$VGS_2-VGS_1=(\sqrt{N}-1)(VGS_1-VT) \quad \text{Equation 9}$$

$$\text{Example: } N=4, VGS_2-VGS_1=(VGS_1-VT)=VDSAT_1 \quad \text{Equation 10}$$

$$\text{Example: } N=9, VGS_2-VGS_1=2(VGS_1-VT)=2VDSAT_1 \quad \text{Equation 11}$$

Based upon the foregoing, because transistors N2 and N1 are scaled to have equal channel widths and lengths, they will have equal gate-to-source voltages VGS. Accordingly, the source terminal of transistor N1 will be one output saturation voltage VDSAT above circuit ground VSS/GND, thereby maintaining transistor N2 in saturation. As a result, this circuit 100*a* is capable of operating with a power supply voltage as low as the sum of one threshold voltage VT (transistor N1) plus two output saturation voltages VDSAT (transistor N2 and current source 112), i.e., VT+2VDSAT, while requiring only one input reference current source 112 and still providing a cascode output. Additionally, with the high impedance node of the feedback loop located at one of the outputs of the circuit, i.e., the drain terminal of transistor N1, compensation for maintaining good phase margin for the feedback loop is easily achieved.

Figure 3:
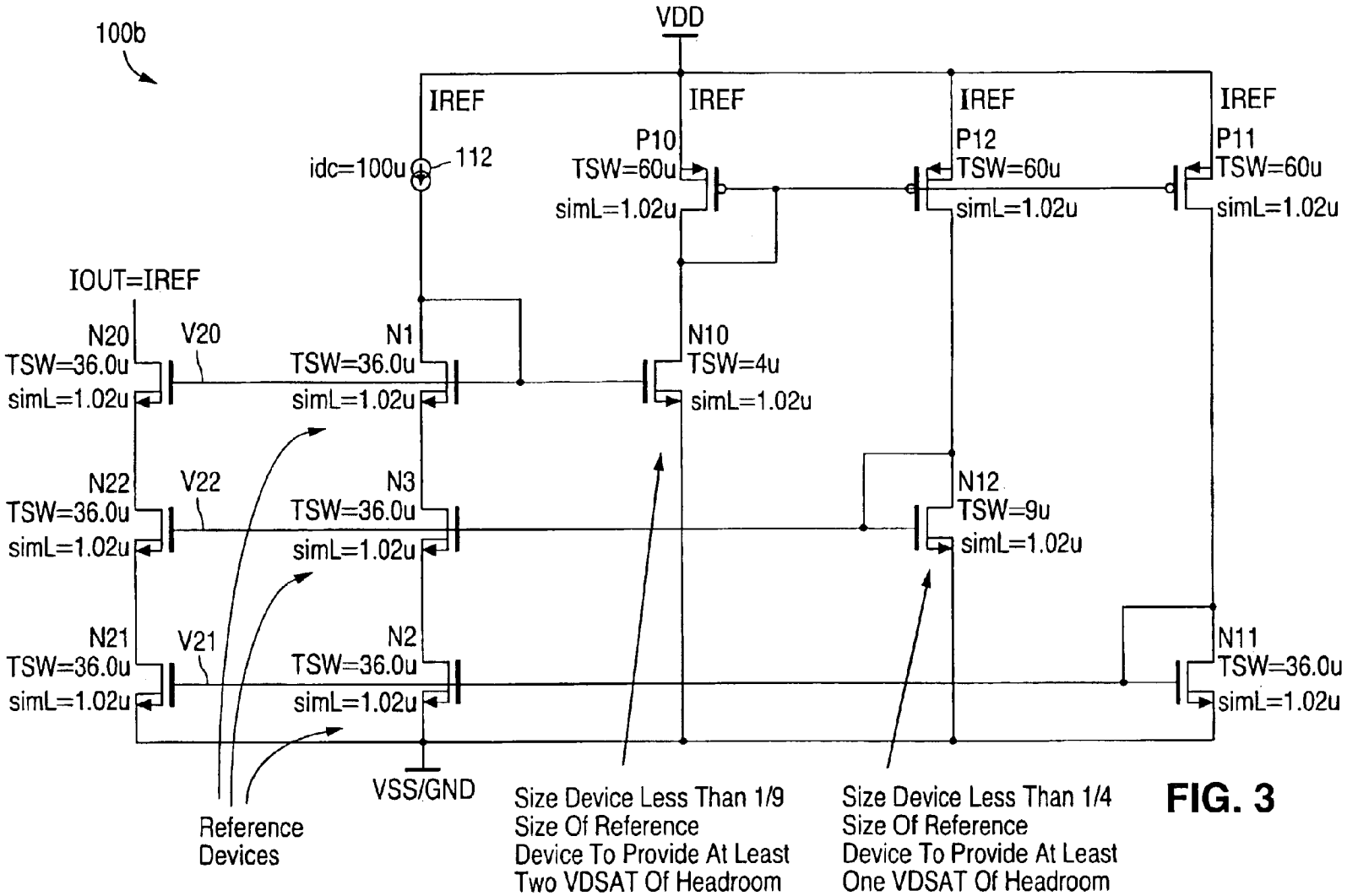
FIG. 3 is a schematic diagram of a MOSFET cascode current mirror circuit in accordance with another embodiment of the presently claimed invention.

Referring to FIG. 3, the principles discussed above in connection with the circuit 100*a* of FIG. 2 can be scaled to include multiple cascode output devices as shown in this circuit 100*b*. In this circuit 100*b*, an additional cascode device, transistor N22, is inserted into the output circuit, along with corresponding reference N3 and biasing N12 transistors. As before, the biasing voltage V20 produced at the gate terminal of transistor N10 generates the reference current IREF through transistors P10 and N10, which is mirrored in current mirror output transistors P11 and P12. These same reference currents IREF are sunk by diode-connected biasing transistors N11 and N12 to produce the biasing voltages V21, V22 for output transistors N21 and N22, respectively. In accordance with the example equations provided above, transistor N10 is scaled to have a channel width approximately equal to or less than $1/N^2$ (⅙ in this example) of the channel widths of the reference transistors N1, N2, N3 (where N equals the number of reference transistors). Similarly, transistor N12, since it drives a reference transistor N3 which is lower in the stack of reference transistors N1, N3, N2, is scaled to have a channel width approximately equal to or less than $1(N-1)^2$ (¼ in this example) of the channel widths of the reference transistors N1, N2, N3.

Figure 4:
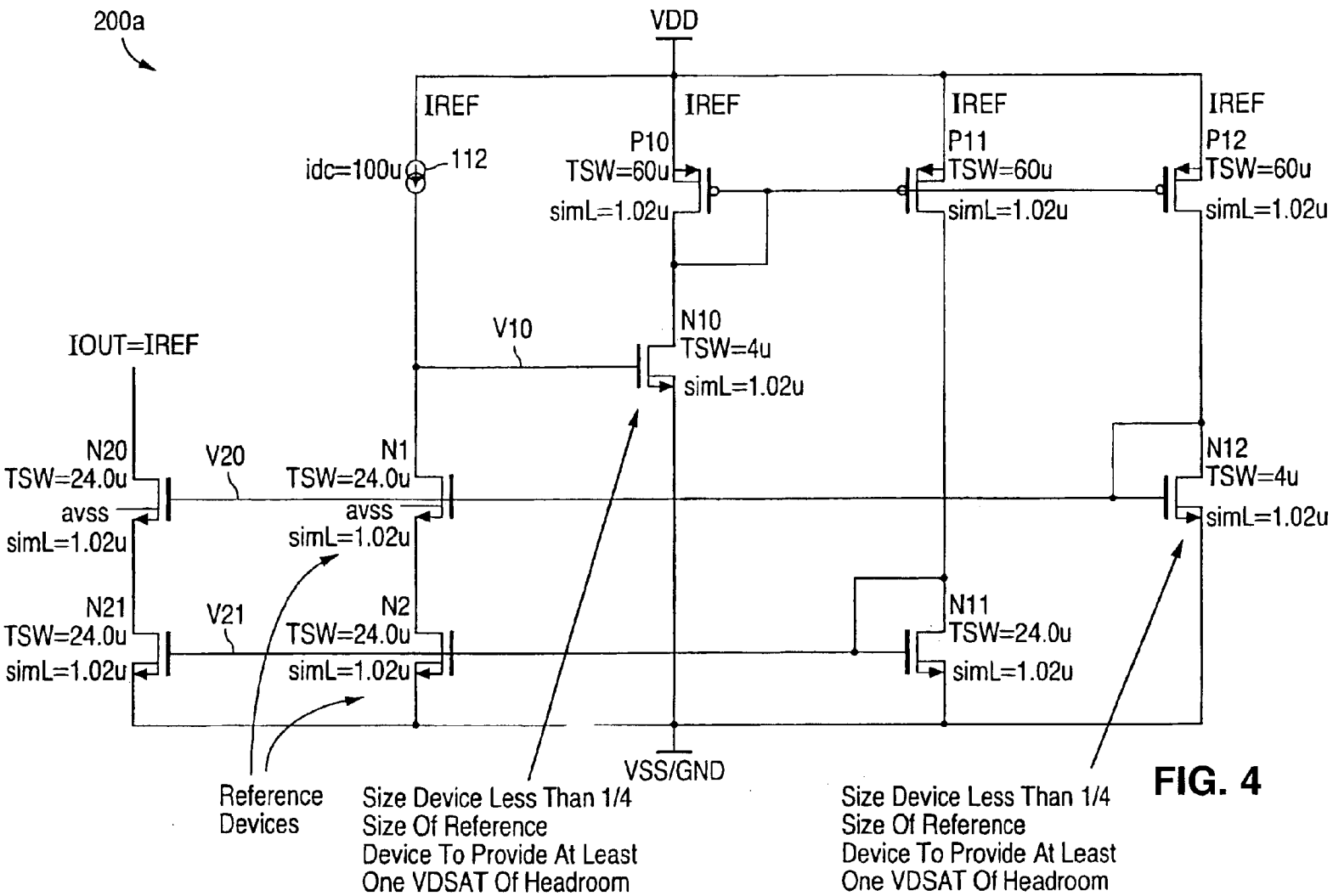
FIG. 4 is a schematic diagram of a MOSFET cascode current mirror circuit in accordance with another embodiment of the presently claimed invention.

Referring to FIG. 4, a MOSFET cascode current mirror circuit 200*a* in accordance with another embodiment of the presently claimed invention is a variation of the circuit 100*a* of FIG. 2. In this circuit 200*a*, the output biasing voltages V20, V21 are provided such that the final cascode output biasing voltage V20 is decoupled from the high impedance node present at the drain terminal of reference transistor N1. Accordingly, the reference voltage V10 which biases the scaled transistor N10 at the input to the current mirror circuit P10/P11/P12 is decoupled from biasing of the cascode output transistor N20.

Figure 5:
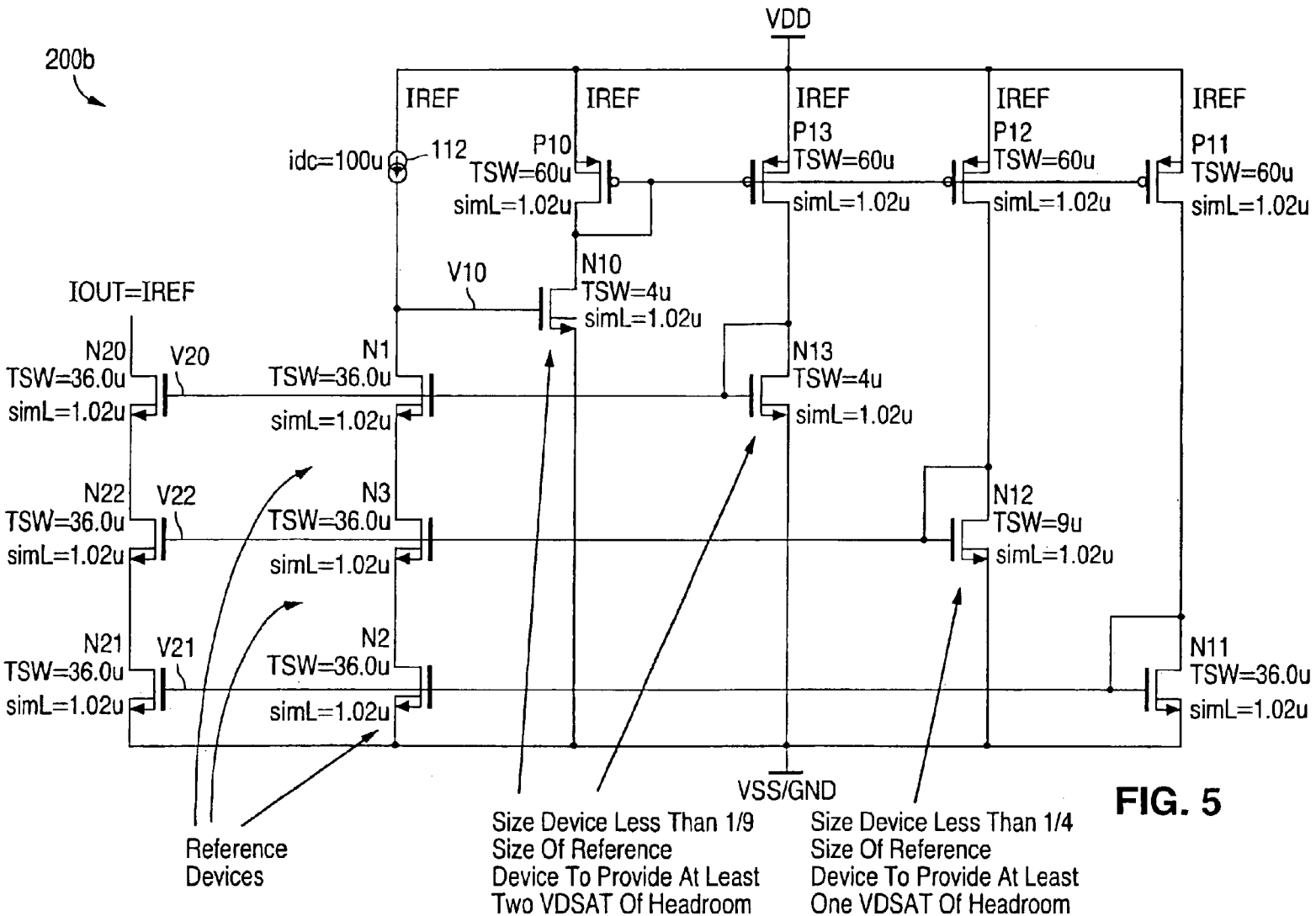
FIG. 5 is a schematic diagram of a MOSFET cascode current mirror circuit in accordance with another embodiment of the presently claimed invention.

Referring to FIG. 5, a circuit 200*b* in accordance with another embodiment of the presently claimed invention is a variation on the circuit 200*a* of FIG. 4. In this circuit 200*b*, the number of cascode output transistors has been increased from one to two. The diode-connected transistors N12, N13 responsible for biasing the cascode output transistors N22, N20 are scaled in a manner similar to that discussed above for the circuit 100*b* of FIG. 3.

Figure 6:
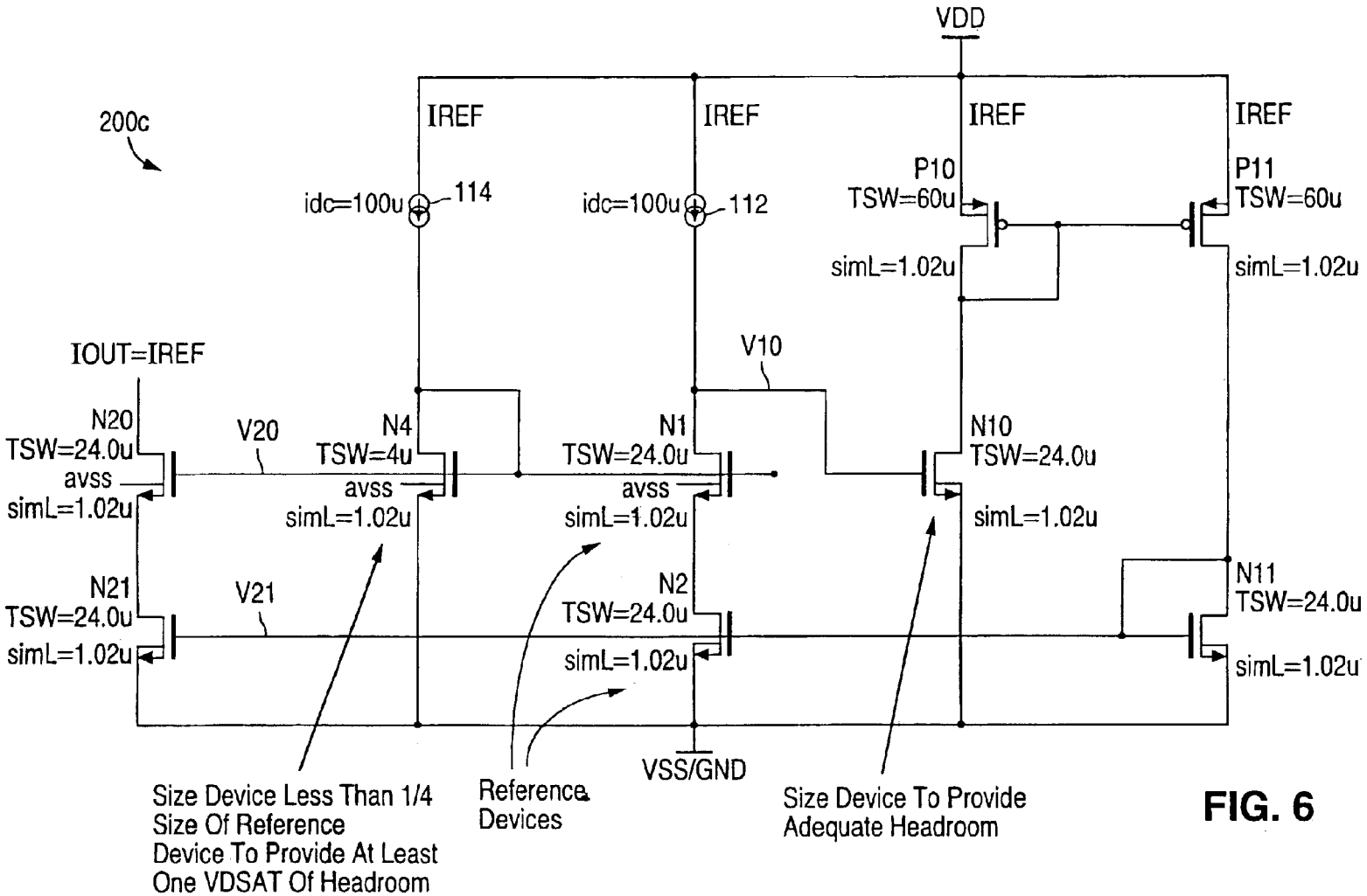
FIG. 6 is a schematic diagram of a MOSFET cascode current mirror circuit in accordance with another embodiment of the presently claimed invention.

Referring to FIG. 6, a circuit 200*c* in accordance with another embodiment of the presently claimed invention shares some similarities with the circuits 100*a*, 200*a* discussed above for FIGS. 2 and 4. For example, the high impedance node present at the drain terminal of reference transistor N1 is decoupled from the cascode output transistor N20, similar to the circuit 200*a* of FIG. 4, while diode-connected transistor N4 provides the biasing voltage V20 for the cascode output transistor N20, similar to the circuit 100*a* of FIG. 2. However, this circuit 200*c* does require an additional reference current source 114.

Figure 7:
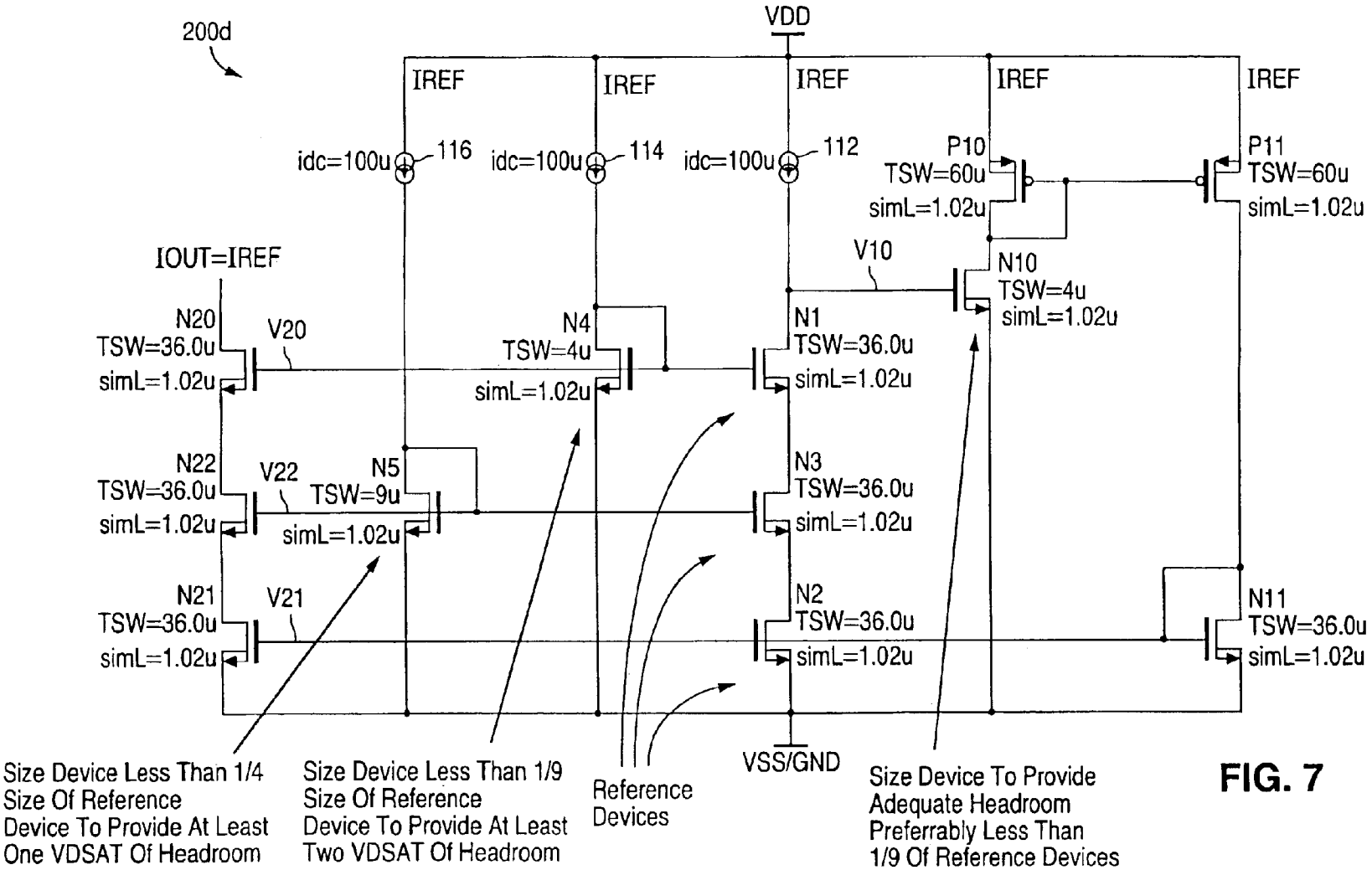
FIG. 7 is a schematic diagram of a MOSFET cascode current mirror circuit in accordance with another embodiment of the presently claimed invention.

Referring to FIG. 7, a circuit 200*d* in accordance with another embodiment of the presently claimed invention is a variation on the circuit 200*a* of FIG. 4. For example, the high impedance node present at the drain terminal of reference transistor N1 is decoupled from the biasing circuit for the cascode output transistor N20. Unlike the circuit 200*a* of FIG. 4, however, the biasing voltages V20, V22 for the cascode output transistors N20, N22 are provided by diode-connected, scaled transistors N4, N5 which are biased by separate reference current sources 114, 116. In conformance with the discussion above, transistors N10, N14 and N5 are scaled in terms of their respective channel widths to provide appropriate biasing with respect to the reference transistors N1, N2, N3 and output transistors N20, N21, N22.

various other modifications and alternations in the structure and method of operation of this invention will be apparent to those skilled in the art without departing from the scope of the spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including metal oxide semiconductor field effect transistor (MOSFET) cascode current mirror circuitry, comprising:

reference circuitry including a first plurality of N telescopically coupled MOSFETs having a first plurality of like corresponding channel dimensions and responsive to reception of a reference current and at least one feedback voltage by providing a reference voltage, wherein N is an integer greater than unity;

feedback circuitry coupled to said reference circuitry, including at least one scaled MOSFET, and responsive to reception of said reference voltage by providing said at least one feedback voltage in relation to said reference voltage, wherein one of said at least one scaled MOSFET has a channel dimension approximately equal to or less than $1/N^2$ of a corresponding one of said first plurality of reference circuitry MOSFET channel dimensions and is responsive to said reference voltage; and cascode output circuitry coupled to said reference circuitry and said feedback circuitry, and responsive to direct reception of said reference voltage and said at least one feedback voltage by providing a cascode output current related to said reference current.

2. The apparatus of claim 1, wherein another one of said at least one scaled MOSFET has a channel dimension approximately equal to or less than $1/(N-1)^2$ of said corresponding one of said first plurality of reference circuitry MOSFET channel dimensions and provides one of said at least one feedback voltage.

3. The apparatus of claim 1, wherein:

one of said at least one scaled MOSFET is responsive to reception of said reference voltage by providing a first current; and said feedback circuitry further includes current mirror circuitry, coupled to said one of said at least one scaled MOSFET, responsive to reception of said first current by providing a second current in relation to said first current, and an output MOSFET, coupled to said current mirror circuitry, responsive to reception of said second current by providing one of said at least one feedback voltage.

4. The apparatus of claim 3, wherein:

said current mirror circuitry is further responsive to reception of said first current by providing a third current in relation to said first current;

another one of said at least one scaled MOSFET is coupled to said current mirror circuitry and responsive to reception of said third current by providing another one of said at least one feedback voltage.

5. The apparatus of claim 4, wherein said another one of said at least one scaled MOSFET has a channel dimension approximately equal to or less than $1/(N-1)^2$ of said corresponding one of said first plurality of reference circuitry MOSFET channel dimensions.

6. The apparatus of claim 1, wherein said cascode output circuitry comprises a second plurality of N telescopically coupled MOSFETs having a second plurality of like corresponding channel dimensions substantially equal to respective corresponding ones of said first plurality of reference circuitry MOSFET channel dimensions.

7. The apparatus of claim 6, wherein each one of said second plurality of N telescopically coupled MOSFETs is responsive to reception of a respective one of said reference and at least one feedback voltages.

8. An apparatus including metal oxide semiconductor field effect transistor (MOSFET) cascode current mirror circuitry, comprising:

reference circuitry including a first plurality of N telescopically coupled MOSFETs having a first plurality of like corresponding channel dimensions and responsive to reception of a reference current and at least one feedback voltage by providing a reference voltage, wherein N is an integer greater than unity and one of said first plurality of N telescopically coupled MOSFETs comprises a diode-connected MOSFET responsive to reception of said reference current by providing said reference voltage;

feedback circuitry coupled to said reference circuitry, including at least one scaled MOSFET, and responsive to reception of said reference voltage by providing said at least one feedback voltage in relation to said reference voltage, wherein one of said at least one scaled MOSFET has a channel dimension approximately equal to or less than $1/N^2$ of a corresponding one of said first plurality of reference circuitry MOSFET channel dimensions and is responsive to said reference voltage; and cascode output circuitry coupled to said reference circuitry and said feedback circuitry, and responsive to reception of said reference voltage and said at least one feedback voltage by providing a cascode output current related to said reference current.

9. An apparatus including metal oxide semiconductor field effect transistor (MOSFET) cascode current mirror circuitry, comprising:

reference circuitry including a first plurality of N telesoopically coupled MOSFETs having a first plurality of like corresponding channel dimensions and responsive to reception of at least one reference current and at least one feedback voltage by providing at least one reference voltage, wherein N is an integer greater than unity;

feedback circuitry coupled to said reference circuitry, including at least one scaled and diode-connected MOSFET, and responsive to reception of one of said at least one reference voltage by providing said at least one feedback voltage in relation to said one of said at least one reference voltage, wherein at least one of said at least one scaled MOSFET has a channel dimension approximately equal to or less than $1/N^2$ of a corresponding reference circuitry MOSFET channel dimension and is responsive to said one of said at least one reference voltage; and cascode output circuitry coupled to said feedback circuitry, including a second plurality of N telescopically coupled MOSFETs, and responsive to reception of said at least one feedback voltage by providing a cascode output current related to one or more of said at least one reference current.

10. The apparatus of claim 9, wherein another one of said at least one scaled MOSFET has a channel dimension approximately equal to or less than $1/N^2$ of said corresponding one of said first plurality of reference circuitry MOSFET channel dimensions and provides one of said at least one feedback voltage.

11. The apparatus of claim 10, wherein still another one of said at least one scaled MOSFET has a channel dimension approximately equal to or less than $1/(N-1)^2$ of said corresponding one of said first plurality of reference circuitry MOSFET channel dimensions and provides another one of said at least one feedback voltage.

12. The apparatus of claim 9, wherein:

one of said at least one scaled MOSFET is responsive to reception of said one of said at least one reference voltage by providing a first current, and said feedback circuitry further includes current mirror circuitry, coupled to said one of said at least one scaled MOSFET, responsive to reception of said fist current by providing a second current in relation to said first current, and an output MOSFET, coupled to said current mirror circuitry, responsive to reception of said second current by providing one of said at least one feedback voltage.

13. The apparatus of claim 12, wherein:

said current mirror circuitry is further responsive to reception of said first current by providing a third current in relation to said first current;

another one of said at least one scaled MOSFET is coupled to said current mirror circuitry and responsive to reception of said third current by providing another one of said at least one feedback voltage.

14. The apparatus of claim 13, wherein said another one of said at least one scaled MOSFET has a channel dimension approximately equal to or less than $1/N^2$ of said corresponding one of said first plurality of reference circuitry MOSFET channel dimensions.

15. The apparatus of claim 13, wherein:

said current mirror circuitry is filter responsive to reception of said first current by providing a fourth current in relation to said first current;

still another one of said at least one scaled MOSFET is coupled to said current mirror circuitry and responsive to reception of said fourth current by providing still another one of said at least one feedback voltage.

16. The apparatus of claim 15, wherein said still another one of said at least one scaled MOSFET has a channel dimension approximately equal to or less than $1/(N-1)^2$ of said corresponding one of said first plurality of reference circuitry MOSFET channel dimensions.

17. An apparatus including metal oxide semiconductor field effect transistor (MOSFET) cascode current mirror circuitry, comprising:

reference circuitry including a first plurality of N telescopically coupled MOSFETs having a first plurality of like corresponding channel dimensions and responsive to reception of at least one reference current and at least one feedback voltage by providing at least one reference voltage, and further including one or more diode-connected MOSFETs responsive to reception of one or more of said at least one reference current by providing another one or more of said at least one reference voltage, respectively, wherein N is an integer greater than unity;

feedback circuitry coupled to said reference circuitry, including at least one scaled MOSFET, and responsive to reception of one of said at least one reference voltage by providing said at least one feedback voltage in relation to said one of said at least one reference voltage, wherein at least one of said at least one scaled MOSFET has a channel dimension approximately equal to or less than $1/N^2$ of a corresponding reference circuitry MOSFET channel dimension and is responsive to said one of said at least one reference voltage; and cascode output circuitry coupled to said feedback circuitry, including a second plurality of N telescopically coupled MOSFETs, and responsive to reception of said at least one feedback voltage by providing a cascode output current related to one or more of said at least one reference current.

18. The apparatus of claim 17, wherein one of said one or more diode-connected MOSFETs has a channel dimension approximately equal to or less than $1/N^2$ of said corresponding one of said first plurality of reference circuitry MOSFET channel dimensions.

19. The apparatus of claim 18, wherein another one of said one or more diode-connected MOSFETs has a channel dimension approximately equal to or less than $1/(N-1)^2$ of said corresponding one of said first plurality of reference circuitry MOSFET channel dimensions.

20. An apparatus including metal oxide semiconductor field effect transistor (MOSFET) cascode current mirror circuitry, comprising:

reference circuitry including a first plurality of N telescopically coupled MOSFETs having a first plurality of like corresponding channel dimensions and responsive to reception of at least one reference current and at least one feedback voltage by providing at least one reference voltage, wherein N is an integer greater than unity;

feedback circuitry coupled to said reference circuitry, including at least one scaled MOSFET, and responsive to reception of one of said at least one reference voltage by providing said at least one feedback voltage in relation to said one of said at least one reference voltage, wherein at least one of said at least one scaled MOSFET has a channel dimension approximately equal to or less than $1/N^2$ of a corresponding reference circuitry MOSFET channel dimension and is responsive to said one of said at least one reference voltage; and cascode output circuitry coupled to said feedback circuitry, including a second plurality of N telescopically coupled MOSFETs, and responsive to reception of said at least one feedback voltage by providing a cascode output current related to one or more of said at least one reference current, wherein said cascode output circuitry comprises a second plurality of N telescopically coupled MOSFETs having a second plurality of like corresponding channel dimensions substantially equal to respective corresponding ones of said first plurality of reference circuitry MOSFET channel dimensions.

21. The apparatus of claim 20, wherein each one of said second plurality of N telescopically coupled MOSFETs is responsive to reception of a respective one of said at least one reference and at least one feedback voltages.

* * * * *

UNITED STATES PATENT AND TRADEMARK OFFICE

CERTIFICATE OF CORRECTION

PATENT NO. : 6,906,583 B1
DATED : June 14, 2005
INVENTOR(S) : Aude, Arlo

It is certified that error appears in the above-identified patent and that said Letters Patent is hereby corrected as shown below:

Title page,
Item [57], ABSTRACT,
Line 4, delete "number" and insert -- current --.

Column 5,
Line 8, (Equation 4), delete "$N(VGS_1\text{-}VT)^2 = (VGS_2\text{-}VT)$", insert -- $N(VGS_1\text{-}VT)^2 = (VGS_2\text{-}VT)^2$ --.

Column 6,
Line 38, delete "various" and insert -- Various --.

Column 8,
Line 55, delete "fist", insert -- first --.

Column 9,
Line 9, delete "filter", insert -- further --.

Signed and Sealed this

Thirtieth Day of August, 2005

JON W. DUDAS
*Director of the United States Patent and Trademark Office*